US005950334A

United States Patent [19]

Gerhardt

[11] Patent Number: 5,950,334

[45] **Date of Patent: *Sep. 14, 1999**

[54] FLEXIBLE SPIKED ARRANGEMENT FOR PLACEMENT ONTO FOOTWEAR

[76] Inventor: Douglas S. Gerhardt, 1616 Anderson Pl. SE., Albuquerque, N.Mex. 87108-4404

[ * ] Notice: This patent issued on a continued prosecution application filed under 37 CFR 1.53(d), and is subject to the twenty year patent term provisions of 35 U.S.C. 154(a)(2).

[21] Appl. No.: 08/962,064

[22] Filed: Oct. 31, 1997

[51] Int. Cl.[6] ..... A43B 3/10; A43B 15/00

[52] U.S. Cl. ..... 36/59 R; 36/7.6; 36/7.7

[58] Field of Search ..... 36/7.6, 7.7, 59 R, 36/62, 66

[56] References Cited

U.S. PATENT DOCUMENTS

| | | | |
|---|---|---|---|
| 987,054 | 3/1911 | Eves | 36/7.6 |
| 1,039,928 | 10/1912 | Gray | 36/7.6 |
| 1,182,787 | 5/1916 | Murphy | 36/7.6 |
| 1,487,390 | 3/1924 | King | 36/7.6 |
| 1,935,944 | 11/1933 | Dunn | 36/7.6 |
| 2,668,373 | 2/1954 | Russo | 36/7.6 |
| 2,714,768 | 8/1955 | Badler | 36/7.6 |
| 2,726,461 | 12/1955 | Smith . | |
| 2,807,098 | 9/1957 | Wunker | 36/7.6 |
| 3,019,533 | 2/1962 | Smith . | |
| 3,021,617 | 2/1962 | Koch | 36/7.6 |
| 4,299,037 | 11/1981 | Carey | 36/7.6 |
| 4,525,939 | 7/1985 | McNeil et al. | 36/7.6 |
| 4,635,383 | 1/1987 | Free | 36/7.6 |
| 5,335,429 | 8/1994 | Hansen | 36/62 |
| 5,359,789 | 11/1994 | Bell | 36/7.6 |
| 5,463,823 | 11/1995 | Bell et al. | 36/7.6 |
| 5,533,277 | 7/1996 | Bell et al. | 36/7.6 |
| 5,689,901 | 11/1997 | Bell et al. | 36/7.6 |

*Primary Examiner*—M. D. Patterson
*Attorney, Agent, or Firm*—Robert W. Becker & Associates

[57] ABSTRACT

Flexible spiked arrangements for placement onto footwear are provided. The spiked arrangement has a heel portion for engaging a heel part of the footwear, a toe portion for placement over a toe part of the footwear, and an intermediate bottom sole portion that interconnects the heel and toe portions and is provided with a plurality of spikes. Straps disposed on the heel portion hold the spiked arrangement on the footwear, for example by being strapped around the ankle of a person wearing the spiked arrangement.

19 Claims, 5 Drawing Sheets

FIG.4
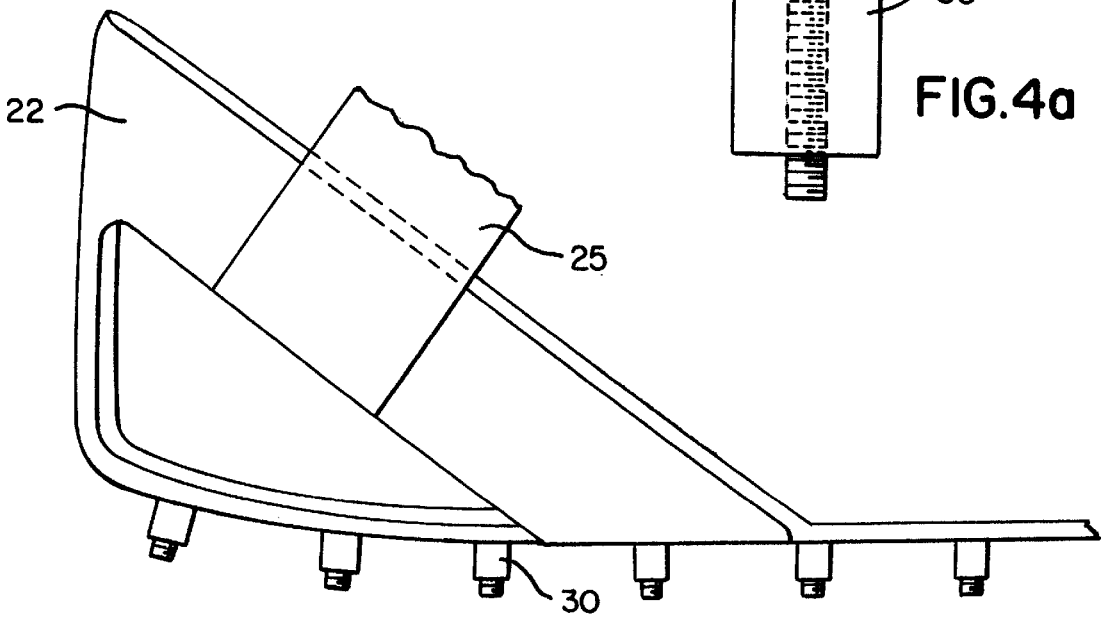
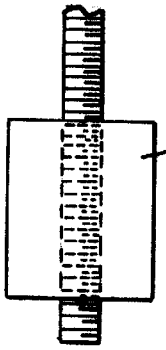
FIG.4a

FLEXIBLE SPIKED ARRANGEMENT FOR PLACEMENT ONTO FOOTWEAR

BACKGROUND OF THE INVENTION

The present invention relates to a flexible spiked arrangement that is adapted to be placed onto footwear.

Such flexible spiked arrangements are very desirable for placing on footwear, such as shoes, especially running shoes, hiking boots, steel-toed boots, such as working boots, etc., especially when it is desired to provide increased traction for the footwear in snowy, icy, muddy, and similar conditions.

Devices to provide improved traction have been suggested in the past. For example, Bell et al, U.S. Pat. No. 5,533,277, provides an ice-gripping sandal that can be strapped onto a boot. Another strap-on sandal is proposed in Bell et al, U.S. Pat. No. 5,463,823, and in Bell, U.S. Pat. No. 5,359,789. A cleated outer sole that can be strapped on is disclosed in Hansen, U.S. Pat. No. 5,335,429. McNeil et al, U.S. Pat. No. 4,525,939, also proposes a spiked attachment for a boot, shoe or the like. A lace-on attachment is disclosed in Koch, U.S. Pat. No. 3,021,617. Two lace-on auxiliary soles are proposed in two patents to Smith, namely U.S. Pat. Nos. 2,726,461 and 3,019,533.

All of these heretofore known attachments have various drawbacks, and it is therefore an object of the present invention to provide an improved and unique flexible spiked arrangement that can be placed onto footwear, and that in particular is easy to put on and take off, is not complicated, and at the same time provides very effective traction.

BRIEF DESCRIPTION OF THE DRAWINGS

This object, and other objects and advantages of the present invention, will appear more clearly from the following specification in conjunction with the accompanying schematic drawings, in which:

FIG. 4 shows an embodiment of the inventive spiked arrangement where these spikes are integrally the sole portion;

FIG. 4*a* shows the spike as a screw-in bolt;

SUMMARY OF THE INVENTION

The flexible spiked arrangement of the present invention is characterized primarily by a heel portion that is adapted to engage a heel part of footwear, a toe portion for placement over the toe part of such footwear, an intermediate bottom sole portion that interconnects the heel and toe portions and is provided with a plurality of spikes, and strap means disposed on the heel portion to hold the spiked arrangement on the footwear, for example by strapping the arrangement about the ankle of a person wearing such footwear.

Pursuant to one specific embodiment of the inventive spiked arrangement, the sole portion can have a first part that is integral with the heel portion, and a second part that is integral with the toe portion, with such first and second parts being interconnected, for example by some of the spikes. The inventive spiked arrangement could also be a single piece, for example being injection molded.

The spiked arrangement of the present invention has a very straightforward construction. It also has numerous other advantages, such as the fact that it is flexible in several directions and therefore easily follows the movement of the foot of a person who has strapped such spiked arrangements onto his or her shoes or boots. The inventive flexible spiked arrangement is also easy to put on and take off, and in addition provides excellent traction. Furthermore, when the inventive spiked arrangement is made of two parts, the length thereof can be adjustable.

Further specific features of the present invention will be described in detail subsequently.

DESCRIPTION OF PREFERRED EMBODIMENTS

Figure 1:
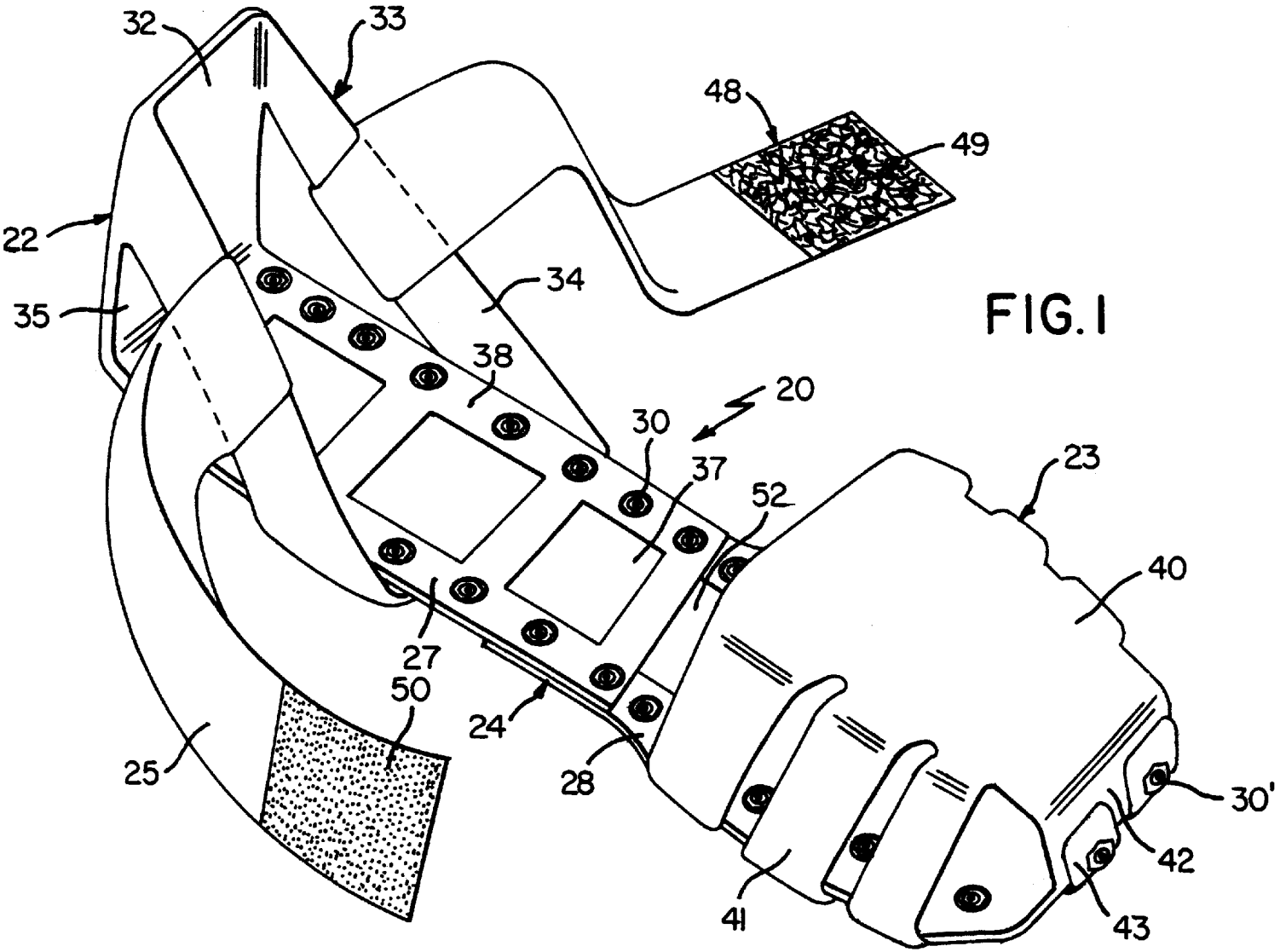
FIG. 1 is an isometric view showing one exemplary embodiment of the inventive flexible spiked arrangement.
Figure 3:
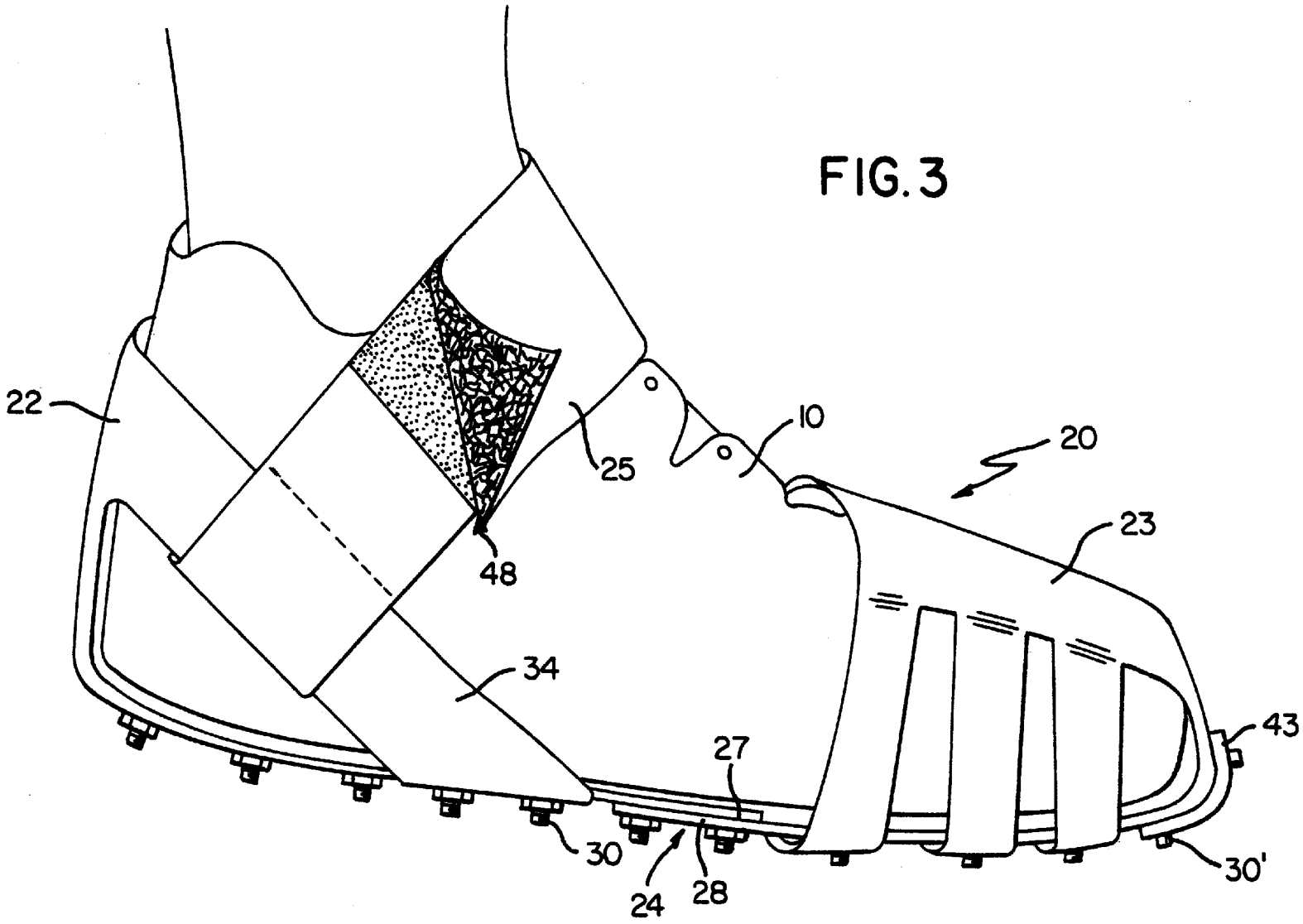
FIG. 3 shows the spiked arrangement of FIG. 1 as it could be strapped about the ankle of a person wearing a running shoe.

Referring now to the drawings in detail, FIG. 1 schematically illustrates one exemplary embodiment of an inventive flexible spiked arrangement which is designed to be attached or secured to footwear, as shown in FIG. 3. The flexible spiked arrangement of the present invention is designated generally by the reference numeral 20.

The flexible spiked arrangement 20 comprises a heel portion 22, which is intended to engage or rest against the heel of footwear, such as the running shoe 10 shown in FIG. 3, and furthermore comprises a toe portion 23 that is placed over the toe part of the shoe 10. In addition, an intermediate bottom sole portion 24 interconnects the heel portion 22 and the toe portion 23 of the flexible spiked arrangement 20. Strap means 25 are connected to the heel portion 22 for securely strapping the spiked arrangement 20 onto the shoe 10 and/or about the ankle of the person using the inventive arrangement. It is to be understood that a person would normally use two such arrangements, one for each foot or shoe.

In the embodiment illustrated in the drawings, the intermediate or bottom sole portion 24 comprises two parts, namely a first part 27 that is integral with the heel portion 22, and a second part 28 that is integral with the toe portion 23. As a result, the inventive flexible spiked arrangement 20 in this embodiment is essentially a two-part device. However, as will be discussed in detail subsequently, the spiked arrangement 20 could also be made of a single piece.

To complete the flexible spiked arrangement 20, a plurality of spikes 30 are disposed primarily on the bottom sole portion 24.

Figure 2:
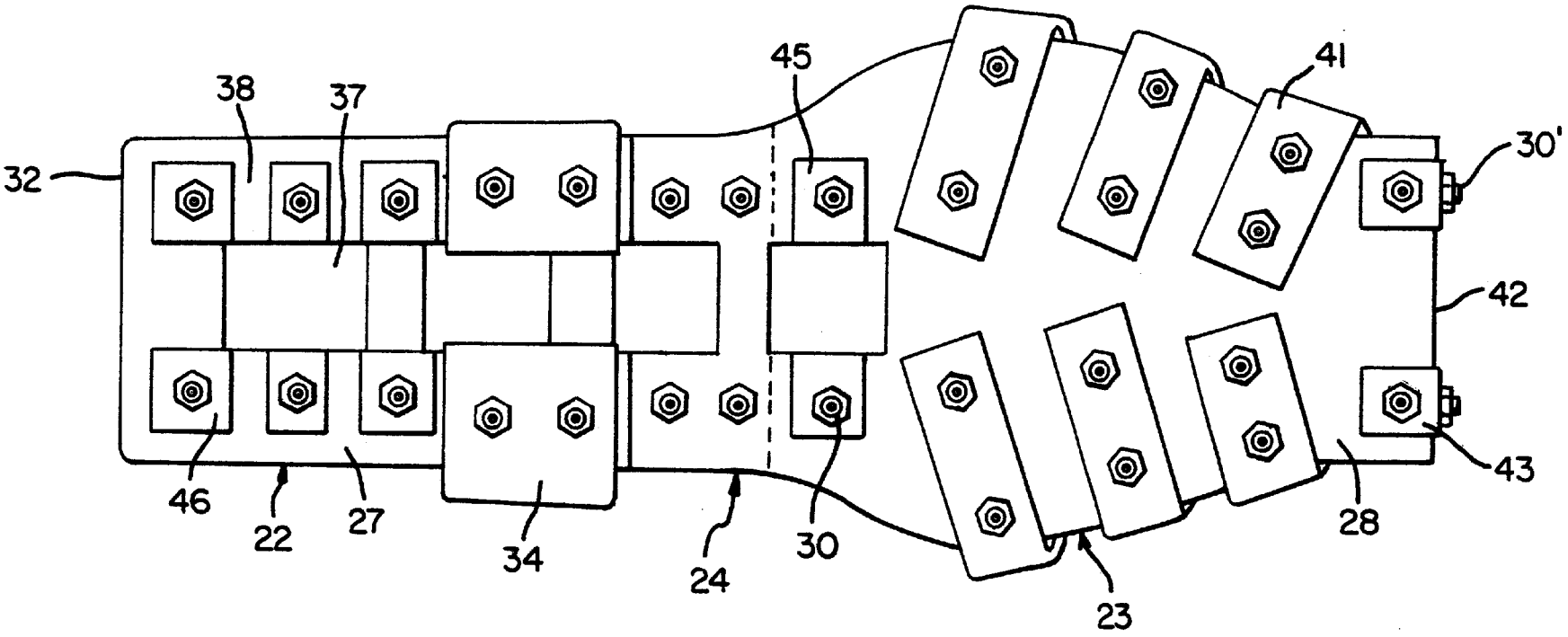
FIG. 2 is a bottom view of the spiked arrangement of 1.

The heel portion 22 can be produced from a flat sheet, preferably made of polymeric material such as a thermoplastic, including high density and ultra-high molecular weight polyethylene. To produce the shape illustrated in the drawings, the back part 32 of the heel portion 22 is produced by folding this part up from the flat sheet. Thereupon, the two side parts 33 are produced by bending forward the two strips 34 and then fastening each to the bottom of the intermediate sole portion 24 with one or more spikes 30. As can be seen in FIG. 2, in the illustrated embodiment each side strip 34 is connected to the sole portion 24 by two such spikes 30.

As an alternative to forming the heel portion 22 from a flat strip, such heel portion could also be a molded part, such as an injection molded part, wherein the open areas 35 formed when the strips 34 are bent forward could be omitted, although cutouts to form the open areas 35 could also be provided in a molded part. Using a molded part would also make it easier to provide a somewhat rounded back part 32, although providing further cutouts in the back part 32 would also enable a rounded back to be made using a flat sheet.

The first part 27 of the intermediate sole portion 24, which in the illustrated embodiment is, as discussed previously, integral with the heel portion 22, is provided with at least one and preferably a plurality of cutouts 37; in the illustrated embodiment, the first part 27 is provided with three such cutouts 37. The sides 38 of the first part 27 of the sole portion 24 are each provided with holes for the spikes 30. Thus, in the illustrated embodiment two rows of spikes 30 are provided on the first part 27.

The toe portion 23 can be formed in a manner similar to that described in conjunction with the heel portion 22. In particular, the toe portion 23 can be formed from a flat sheet, preferably again made of polymeric material, or can be injection molded. To form the toe portion 23 from a flat sheet, the top part 40 thereof is provided by folding it over by 180° from the flat base portion. Thereupon, the strips 41 are folded back under the thus formed second part 28 of the sole portion 24 and are secured thereto via spikes 30. This forms open areas 44 between the strips 41. The front end 42 of the toe portion 23 can also be provided with spikes 30'. Since a double thickness of the polymeric material of the spiked arrangement 20 is preferred at the location of the spikes 30, 30', two short strips 43 are provided at the front end 42 of the toe portion 23. The upper end of the strips 43 are connected to the front end 42 by the spikes 30', whereas the bottom ends of the strips 43 are connected to the second part 28 of the sole portion 24 by spikes 30. In order to provide such a double layer of material at the location of any spikes 30 where a double layer does not otherwise exist, for example due to the presence of the strips 41 of the top part 40 of the toe portion 23, the presence of the strips 34 of the side parts 33 of the heel portion 22, or where the first and second parts 27, 28 of the sole portion 24 overlap, additional strips can be provided, such as the short strips or pieces 45 for the second part 28 and the short strips or pieces 46 for the first part 27. This provides stronger attachment zones, if desired. It should also be noted that rather than being provided with the three respective side strips 41 as illustrated, any number of strips could be provided. In addition, the sides could also be solid, although the strips 41 are desirable since the open areas 44 provide additional flexibility for the inventive arrangement. Furthermore, for special applications additional spikes could be provided near the bottom of the side strips 41, which would then be more rounded at that location, or the sides of the second part 28 of the sole portion 24 could be rolled up to accommodate spikes.

As indicated previously, the strap means 25 for attaching the flexible spiked arrangement 20 to a shoe preferably comprises two straps, one attached to each of the strips 34 of the side parts 33 of the heel portion 22. The straps 25 can be made of plastic, nylon, some other non-tubular webbing, or any other suitable material, for example as 2 inch wide strips, and can be attached to the strips 34 in any convenient manner; in the illustrated embodiment, the straps 25 are looped around the strips 34, with respective closed loops being formed, for example by having the loop sewn to the remainder of the strap. In addition, the strap means 25 are provided with fastener means 48. In particular, each strap of the strap means 25 is provided with a cooperating part 49, 50. Such a fastener means 48 is preferably in the form of Velcro, namely a hook and loop type fastener. However, any other suitable fastener or retention means could be used. However, a Velcro fastener means 48 provides not only very good strength but also ease in attachment and release, especially if the user is wearing heavy gloves.

As can be seen from the drawings, the two halves of the inventive flexible spiked arrangement 20 are interconnected where the first and second parts 27, 28 of the sole portion 24 overlap one another; at such overlap, the two halves are interconnected by spikes 30.

Figure 1A:
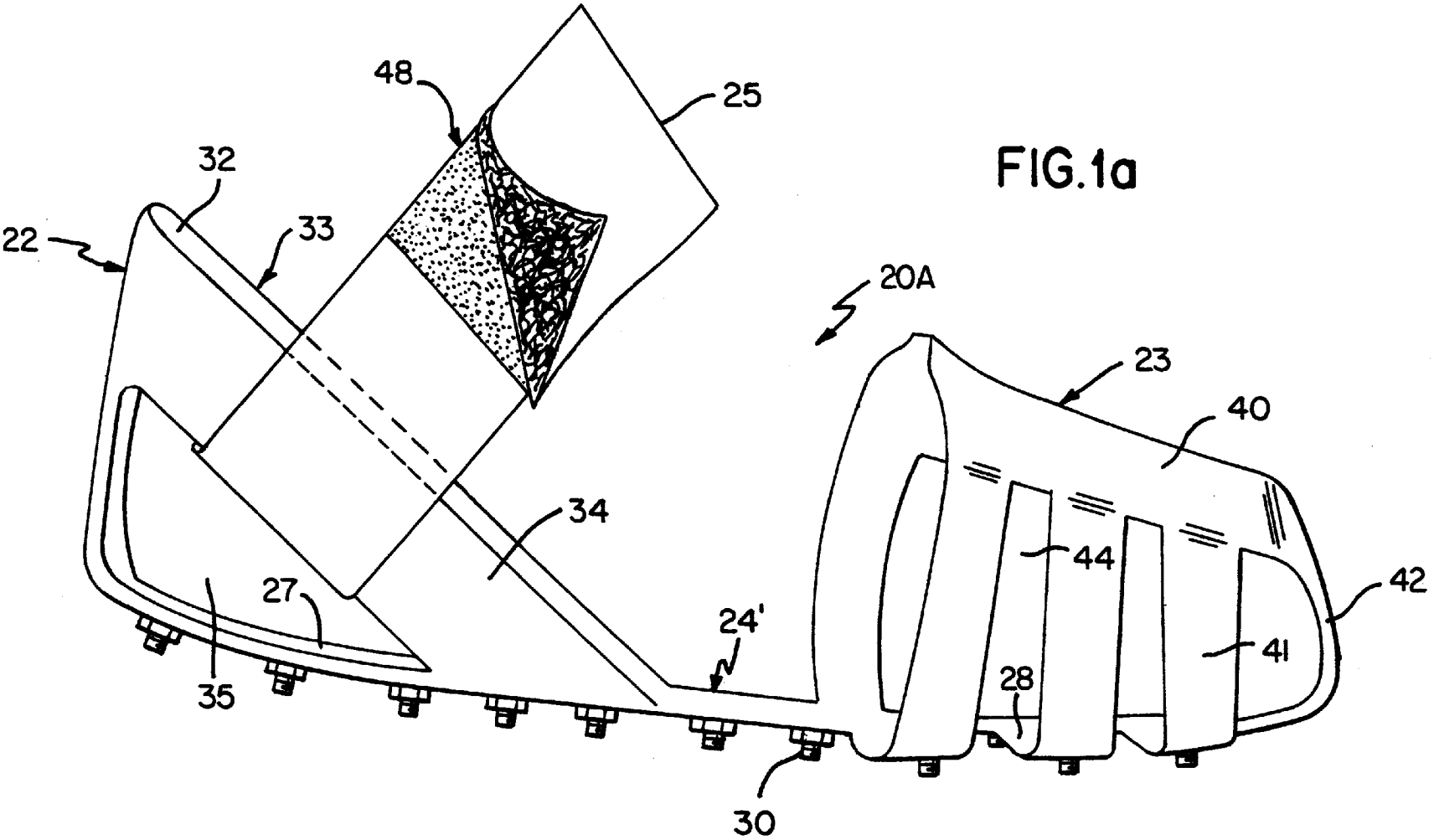
FIG. 1*a* is a modified embodiment of the spiked arrangement of FIG. 1.

The inventive spiked arrangement 20 has been described as comprising two halves. It would also be possible to produce the spiked arrangement 20 as a single component (FIG. 1*a*). However, if the spiked arrangement 20 is made as two halves, the possibility of being able to adjust the length between the heel and toe portions 22, 23 is provided in order to be able to fit the arrangement to different types of footwear as well as to provide different sizes for different people.

In a manner similar to that described in conjunction with the first part 27 of the sole portion 24, the second part 28 thereof can also be provided with one or more cutouts 52. In addition, the second part 28 of the sole portion 24 is also provided with a number of spikes 30. In the illustrated embodiment, at the location of each of the strips 41 a total of four such spikes 30 is provided as viewed from one side of the sole portion 24 to the other side, due to the fact that each strip 41 is connected to the second part 28 on the bottom by two such spikes 30. However, it would also be conceivable to connect the strips 41 to the second part 28 with only a single spike 30. At the location of the front strips 43, the number of spikes 30 will be equal to the number of such strips 43.

Each of the spikes 30, 30' is preferably a bolt and nut arrangement, with the heads of the bolts being flat or rounded off, e.g. of the button head type, to minimize impact upon the sole of a shoe, and hence upon the foot of a person wearing the inventive spiked arrangement 20. The bolt heads can also be recessed in the surface of the inner side of the sole portion 24. Similarly, the nuts could be disposed in recesses of the sole portion.

Although the present invention is, of course, not limited to any specific size of spike, one specific embodiment of the present invention uses spikes where the bolt is a 6–32, grade 8 aircraft alloy steel bolt, and has a length of ½–¾ inch. Although the drawing shows the flexible spiked arrangement 20 as having thirty-two spikes 30, 30', this will vary depending upon where the first and second parts 27, 28 of the sole portion 24 overlap one another. However, it is believed that at least twenty spikes should be provided. In addition, although the illustrated embodiment shows the spikes 30' in the front end 42 of the toe portion 23, such spikes 30', as well as the spikes 30 at the bottom of the pertaining short strips 43, need not necessarily be provided.

The spikes 30, 30' can all be disposed perpendicular to a plane of, for example, the sole portion 24 or the front end 42, can all extend at an angle to such plane, or some of the spikes can extend perpendicular while some are disposed at an angle.

Various types and arrangements of the spikes 30, 30' are possible. As previously described, the nut and bolt arrangement can itself provide for the spikes, wherein different length bolts could be used for one and the same spiked arrangement 20 in order to accommodate conditions existing at any given time, and in which the inventive spiked arrangement is to be utilized. In addition, it would also be possible to provide separate spike means, either of metal or plastic, and of varying lengths, sizes and shapes, that could be internally threaded and could screw onto the bolts. Such screw-on spikes would be in the nature of caps for the bolts.

Where the inventive spiked arrangement is produced as an injection molded product, the nuts and/or the bolts, which could again be made of plastic or metal, could be molded right into the unit (FIG. 4). If the nut is molded into or formed as part of the sole portion 24, the bolt (FIG. 4*a*) or spike can then be screwed therethrough. Similarly, if the bolt is molded into the unit, the nut could then be screwed onto the bolt in the manner of a cap and itself form the spike means. Furthermore, the entire spike means could be molded into the unit and be integral therewith.

The present invention is, of course, in no way restricted to the specific disclosure of the specification and drawings, but also encompasses any modifications within the scope of the appended claims.

What I claim is:

1. A flexible spiked arrangement for placement onto footwear, comprising:

a heel portion of polymeric material for engaging a heel part of said footwear;

a toe portion of polymeric material for placement around a toe part of said footwear such that said toe portion surrounds said toe part, wherein said heel portion and said toe portion are separate components that have respective sole portions that are each provided with a plurality of spikes, wherein said sole portions of said toe portion and said heel portion comprise overlapping portions that are interconnected to one another only by some of said spikes, and wherein each of said sole portions remains in a single plane; and strap means disposed only on said heel portion for holding said arrangement on said footwear.

2. A flexible spiked arrangement according to claim 1, wherein said toe portion is also provided with spikes which extend in a substantially forward direction when said arrangement is attached onto footwear.

3. A flexible spiked arrangement according to claim 1, wherein a rear half of said sole portion is provided with two rows of spikes as viewed in a direction from a back of said arrangement to a front thereof, and a front half of said sole portion is provided with at least two rows of said spikes.

4. A flexible spiked arrangement according to claim 3, wherein 20 to 32 spikes are provided.

5. A flexible spiked arrangement according to claim 1, wherein said sale portion of said heel portion is provided with at least one cutout.

6. A flexible spiked arrangement according to claim 5, wherein said sale portion of said toe portion is also provided with at least one cutout.

7. A flexible spiked arrangement according to claim 1, wherein said spikes are respective bolt and nut arrangements.

8. A flexible spiked arrangement according to claim 7, wherein the nuts are threaded caps that screw onto the bolts to form said spikes.

9. A flexible spiked arrangement according to claim 7, wherein caps are provided that screw onto the bolts to form said spikes.

10. A flexible spiked arrangement according to claim 1, wherein said strap means comprises two parts that are respectively disposed on opposite halves of said heel portion and are connected via fastener means.

11. A flexible spiked arrangement according to claim 10, wherein said fastener means is in the form of a hook and loop type fastener.

12. A flexible spiked arrangement according to claim 1, wherein open areas are provided in said toe portion.

13. A flexible spiked arrangement according to claim 1, wherein said spikes are integrally molded into said sole portion.

14. A flexible spiked arrangement according to claim 1, wherein said polymeric material is ultra-high molecular weight polyethylene.

15. A flexible spiked arrangement according to claim 1, wherein said spikes are fixed in position relative to said sole portions of said toe and heel portions.

16. A flexible spiked arrangement according to claim 1, wherein said some of said spikes are provided with means such that these spikes are removable to allow adjustment in overall length of said interconnected sole portions.

17. Aflexible spiked arrangement for placement onto footwear, comprising:

a heel portion of polymeric material for engaging a heel part of said footwear;

a toe portion of polymeric material for placement around a toe part of said footwear such that said toe portion surrounds said toe part, wherein said heel portion and said toe portion are separate components that have respective sole portions that are each provided with a plurality of spikes, wherein said sole portions of said toe portion and said heel portion comprise overlapping portions that are interconnected to one another only by some of said spikes, and wherein each of said sole portions remains in a single plane; and strap means disposed only on said heel portion for holding said arrangement on said footwear, wherein said spiked arrangement is produced from at least one flat sheet, portions of each sheet being folded over and attached to itself via some of said spikes.

18. A flexible spiked arrangement for placement onto footwear, comprising:

a single member of polymeric material having a heel portion for engaging a heel part of said footwear, and a toe portion for placement around a toe part of said footwear such that said toe portion fully surrounds said toe part, wherein said heel portion and said toe portion have respective sole portions that are each provided with a plurality of replaceable spikes, each of which is a nut and bolt arrangement, and wherein said heel portion includes two side parts that each extend from an upper back portion downwardly at an angle to said sole portion thereof; and strap means disposed only on said heel portion for holding said arrangement on said footwear, wherein said strap means are connected to said side parts of said heel portion, and wherein said spiked arrangement is produced from a flat sheet, portions of which are folded over and attached to itself via some of said spikes.

19. A flexible spiked arrangement according to claim 18, wherein said sole portion of at least said heel portion is provided with discrete cutouts.

* * * * *

UNITED STATES PATENT AND TRADEMARK OFFICE

CERTIFICATE OF CORRECTION

PATENT NO. : 5,950,334

DATED : 09/14/99

INVENTOR(S) : Douglas S. Gerhardt

It is certified that error appears in the above-identified patent and that said Letters Patent is hereby corrected as shown below:

Column 5, line 45 "sale" should be --sole--.

Column 5, line 48 "sale" should be --sole--.

Signed and Sealed this

Twenty-fifth Day of April, 2000

*Attest:*

Q. TODD DICKINSON

*Attesting Officer*

*Director of Patents and Trademarks*